United States Patent [19]

Miyake et al.

[11] 4,453,272

[45] Jun. 12, 1984

[54] BASEBALL GLOVE

[75] Inventors: Ichio Miyake, Kawanishi; Kazunori Misono, Toyonaka, both of Japan

[73] Assignee: Mizuno Corporation, Osaka, Japan

[21] Appl. No.: 382,710

[22] Filed: May 27, 1982

[30] Foreign Application Priority Data

May 30, 1981 [JP] Japan ..... 56-79537[U]

[51] Int. Cl.[3] ..... A41D 13/10

[52] U.S. Cl. ..... 2/19

[58] Field of Search ..... 2/11, 19

[56] References Cited

U.S. PATENT DOCUMENTS

| | | | |
|---|---|---|---|
| 2,962,721 | 12/1960 | Espy | 2/11 |
| 3,909,848 | 10/1975 | Brockman | 2/19 |
| 4,279,681 | 7/1981 | Klimezky | 2/19 |

*Primary Examiner*—Louis Rimrodt

*Attorney, Agent, or Firm*—Fleit, Jacobson, Cohn & Price

[57] ABSTRACT

A baseball glove according to this invention comprises an anti-glare web attached between sheaths thereof for the thumb and the index finger. A player can watch a fly by peering through the web without being hindered by the glare of sunlight or stadium lights of illumination.

7 Claims, 8 Drawing Figures

BASEBALL GLOVE

This invention relates to baseball gloves which enable baseball players to catch balls.

Such a baseball glove that has been used hitherto, is provided with a web of leather or the like attached between sheaths thereof for the thumb and the index finger and serving to catch a ball. When a baseball player tries to catch a fly with the glove, he frequently loses sight of and fails to catch a ball because the player is blinded by sunlight at a day game or the stadium lights used to illuminate the field at a night game.

A main object of the present invention is to provide a baseball glove which allows the player to catch a fly without being hindered by the glare of sunlight or stadium lights of illumination.

This object can be achieved by providing a baseball glove having an anti-glare web attached between sheaths thereof for the thumb and the index finger.

The other objects and advantages of the present invention will become more apparent from the following description taken in conjunction with the accompanying drawings in which.

Figure 1:
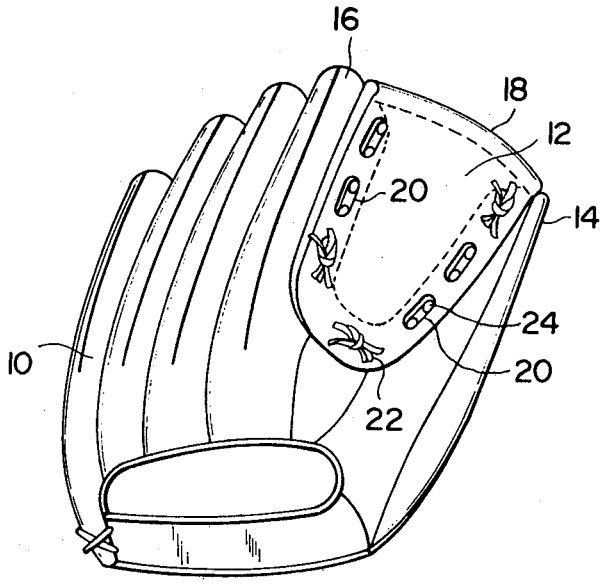
FIG. 1 is a rear perspective view of a baseball glove according to the present invention.
Figure 2:
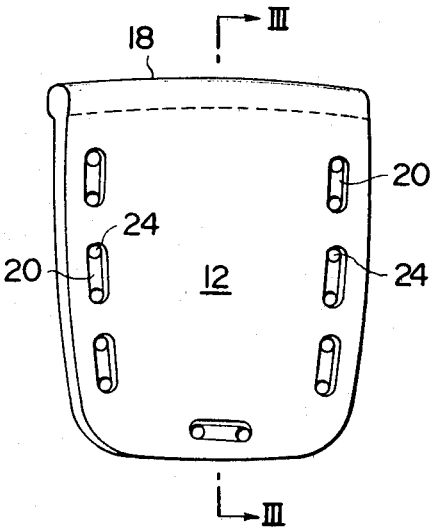
FIG. 2 is a perspective view of an anti-glare web adapted to be attached to the glove.
Figure 3:
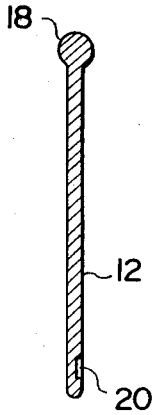
FIG. 3 is a cross-sectional view of the web taken along line 3—3 of FIG. 2.

Referring to FIG. 1 of the drawings, there is shown a baseball glove 10 having an anti-glare web 12 attached between sheaths 14 and 16 for the thumb and the index finger. The web 12 is of a tinted transparent material, such as plastic, having a shock resistance and the upper solid enlarged edge 18 of the web 12 is round in cross-section as shown in FIGS. 2 and 3. The web 12 is provided with a plurality of elongated recesses 20 formed on the rear surface thereof adjacent the side and lower edges of the web to receive leather straps 22. As will be best seen in FIG. 2, apertures 24 are formed in each of the recesses 22 at its ends to permit passage of the straps from the sheaths of the glove through the web. The web 12 is fastened to the sheaths 14 and 16 for the thumb and the index finger with the straps 22 passed through the apertures 24 and tied in the recesses 20.

Figure 4:
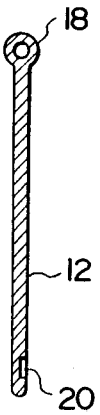
FIG. 4 is a similar view to FIG. 3 showing a web according to another embodiment of the present invention.
Figure 5:
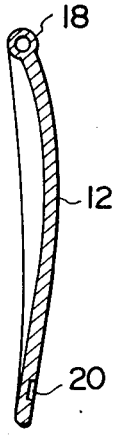
FIG. 5 is a similar view to FIG. 3 showing a web according to a modification of the present invention.
Figure 6:
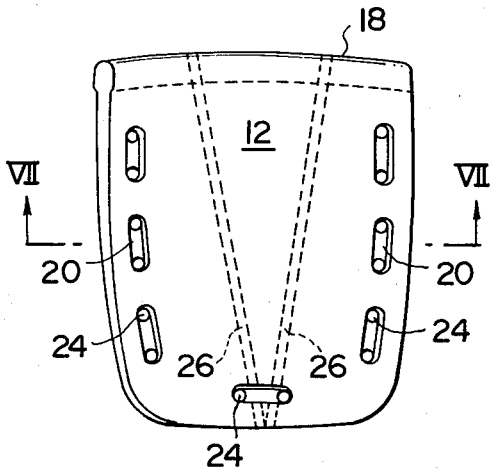
FIG. 6 is a perspective view of a web according to a further modification of the present invention.
Figure 7:
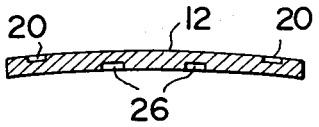
FIG. 7 is a cross-sectional view of the web taken along line 7—7 of FIG. 6.

The upper enlarged edge 18 may be hollow in cross-section as shown in FIG. 4 to permit passage of the straps therethrough in fastening the web to the sheaths with the straps. Although each of the webs as shown in FIGS. 1 to 4 is flat in configuration, it may be of a concave configuration as shown in FIG. 5. FIGS. 6 and 7 show a web 12 having obliquely upwardly extending grooves 26 formed on the front surface thereof to facilitate bending of the web in response to the bending action of the glove.

Figure 8:
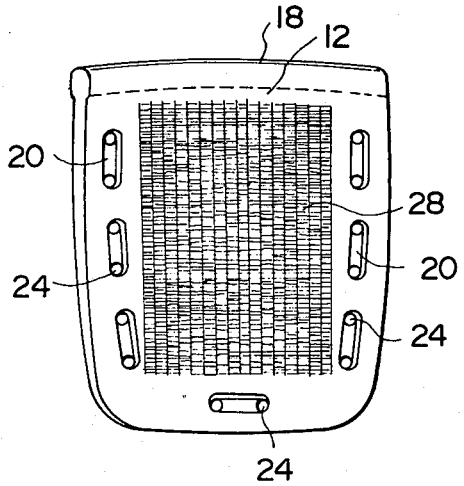
FIG. 8 is a perspective view of a web having an anti-glare net embedded therein.

FIG. 8 shows a transparent or semitransparent plastic web 12 having a net 28 embedded therein and providing an anti-glare effect.

It will be noted that the baseball glove 10 having the tinted transparent web 12 or the net embedded transparent web 12 attached between the thumb and index finger sheaths 14 and 16 with the straps 22 has advantages in that a player can watch a fly by peering through the web 12 and during watching the fly, he is not hindered by the glare of sunlight at a day game or the stadium lights of illumination at a night game.

It will be apparent that the player uses the glove to bring its upper edge of the web into contact with the ground during his playing. In that event, the round or hollow enlarged edge 18 of the web 12 is not liable to wear out. Each of the elongated recesses 20 formed in the web 12 serves to receive the strap 22 extending through the apertures 24 to form a tie for fastening the web 12 to the thumb and index finger sheaths 14 and 16 of the glove 10. The existance of the tied strap in the recess makes it possible to avoid any wear and tear of the strap due to its contact with the ground.

Thus, the use of the glove according to the present invention enables the baseball player to minimize failure in catching a fly due to the anti-glare of sunlight or lights of illumination. It will be appreciated the present invention can also be applied to softball gloves.

What we claim:

1. A baseball glove comprising: a pair of sheaths to receive a thumb and an index finger; a web attached to and extending between said sheaths; the web made of a tinted transparent material having shock resistance.

2. A baseball glove as claimed in claim 1 wherein the web includes an upper edge that is round in cross-section the upper round edge of the web is hollow.

3. A baseball glove as claimed in claim 1 wherein the material of which the web is made is tinted transparent plastic.

4. A baseball glove as claimed in claim 1 wherein the web comprises a transparent plastic piece having an anti-glare net embedded therein.

5. A baseball glove as claimed in claim 1 wherein the web is of a concave configuration.

6. A baseball glove as claimed in claim 1 wherein the web has one or more grooves formed therein to facilitate bending of the web.

7. A baseball glove as claimed in claim 1, wherein said web includes a plurality of elongated recesses formed therein adjacent said sheaths, a plurality of apertures formed in each of said recesses, and straps extending from said sheaths through the apertures in said web and received in said recesses.

* * * * *